United States Patent [19]

Weimann

[11] Patent Number: 5,063,987

[45] **Date of Patent: * Nov. 12, 1991**

[54] APPARATUS FOR COOLING MOLDS

[75] Inventor: Wendelin Weimann, Klettgau, Fed. Rep. of Germany

[73] Assignee: George Fischer AG, Schaffhausen, Switzerland

[ * ] Notice: The portion of the term of this patent subsequent to Jan. 8, 2008 has been disclaimed.

[21] Appl. No.: 522,805

[22] Filed: May 14, 1990

Related U.S. Application Data

[62] Division of Ser. No. 401,945, Sep. 1, 1989, Pat. No. 4,982,778.

[51] Int. Cl.[5] ..... B22C 9/20

[52] U.S. Cl. ..... 164/324

[58] Field of Search ..... 164/130, 131, 322, 323, 164/324, 329, 344, 348

[56] References Cited

U.S. PATENT DOCUMENTS

| | | | |
|---|---|---|---|
| 3,840,066 | 10/1974 | Taccone | 164/323 |
| 4,180,156 | 12/1979 | Popov | 164/323 |
| 4,224,979 | 9/1980 | Rosin | 164/130 |
| 4,438,801 | 3/1984 | Bühler | 164/130 |
| 4,540,036 | 9/1985 | Jensen | 164/323 |
| 4,643,243 | 2/1987 | McKibben | 164/260 |

*Primary Examiner*—Richard K. Seidel
*Assistant Examiner*—Rex E. Pelto
*Attorney, Agent, or Firm*—Bachman & LaPointe

[57] ABSTRACT

A molding process and an apparatus wherein the molds produced in a molding machine are sent past a casting apapratus where casting takes place. Thereafter, the molds with the molding boxes surrounding them, pass through a primary cooling line, at the end of which molds and molding boxes are separated. The molding boxes are returned to the molding machine, while the sand molds with the castings pass through a secondary cooling zone for further cooling. The process allows for a substantially smaller number of molding boxes than previously known molding processes.

1 Claim, 1 Drawing Sheet

APPARATUS FOR COOLING MOLDS

This is a division of application Ser. No. 401,945, filed Sept. 1, 1989, now U.S. Pat. No. 4,982,778.

BACKGROUND OF THE INVENTION

The present invention relates to a molding process and apparatus which eliminates the need for large quantities of molding boxes.

It is known in the prior art to use molding boxes which consist of upper boxes and lower boxes for the production of metal castings. These molding boxes are fed to a molding machine where the upper box and lower box are filled with molding sand to form a mold from a pattern of the piece to be cast. After the insertion of cores and the attachment of pouring cups, the upper box and lower box are put together by means of bolts or the like and the molding boxes are sent in succession to a casting machine where metal is introduced into the mold. After the casting of molten metal, the molding boxes are sent on along a cooling line at the end of which the molding boxes are emptied and the castings are separated from the molding sand. The empty molding boxes are returned again to the molding machine. A typical molding plant is described in U.S. Pat. No. 3,029,482.

After casting, depending on wall thickness and size, the castings need a relatively long period of time until they are cooled sufficiently in order for them to be removed from the molding boxes and separated from the molding sand. This results in a long cooling line and a very large quantity of molding boxes all of which adds to the expense of the molding plant.

It is, therefore, the principle object of the present invention to create a molding process and a molding apparatus which reduces the quantity of molding boxes in circulation.

SUMMARY OF THE INVENTION

The foregoing object is achieved in accordance with the present invention wherein the cooling line in the molding plant is divided into a primary cooling line and a secondary cooling line wherein the molding boxes are only sent over the primary cooling line and not over the secondary cooling line. The castings are ejected from the molding boxes at the end of the primary cooling line at the earliest possible time together with the sand mold which is unitary with the casting. The length of the primary cooling line is dimensioned so that the ejection takes place when the castings have had a sufficient amount of time to firm and solidify the outer shell so they can be supported by the sand molds such that the castings will not tear, burst or metal escape or the geometrical shape of the castings to change substantially during the subsequent transportation along the secondary cooling line. The secondary cooling line comprises a horizontal conveyor having two lateral guide walls. The castings and surrounding sand molds are fed successively in an abutting manner to the secondary cooling line. During transportation along the secondary cooling line, the sand molds and castings are supported on five sides, that is, on the bottom by the horizontal conveyor, on two opposed sides by the lateral guide walls and on the other two opposed sides by the abutting unitary castings and sand molds.

BRIEF DESCRIPTION OF THE DRAWINGS

The present invention is explained in more detail hereinbelow with reference to the drawings of which

DETAILED DESCRIPTION

Figure 1:
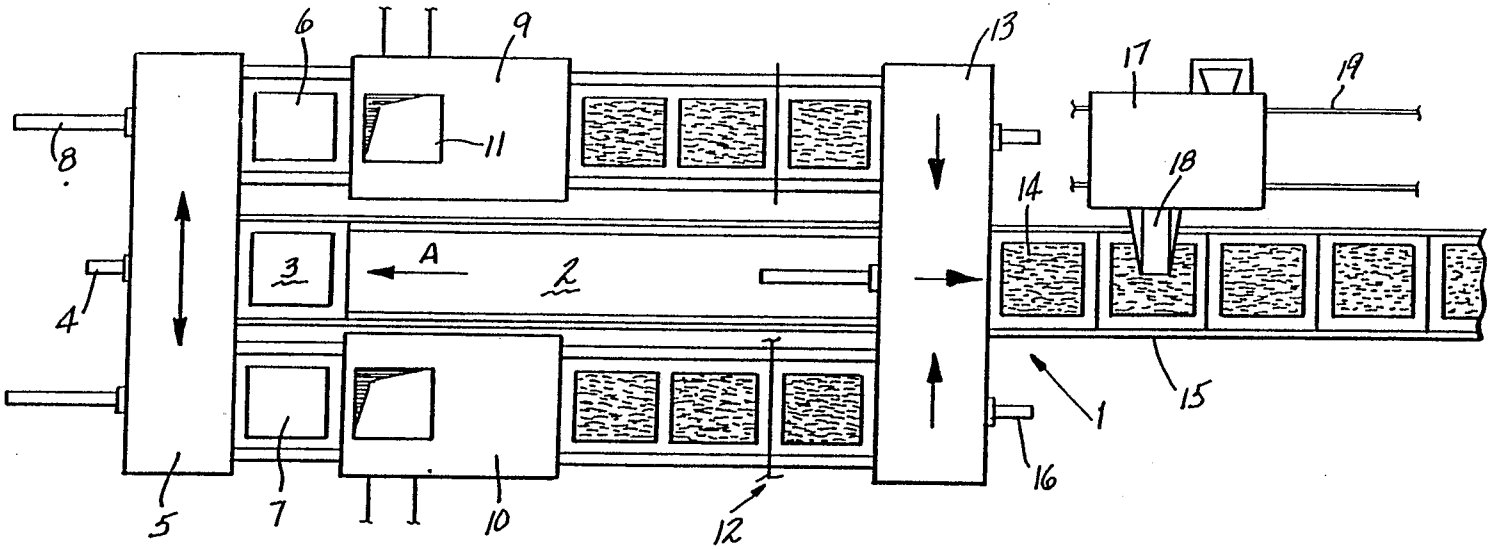
FIGS. 1 and 2 are fragmented schematic illustrations of one embodiment of the molding plant in accordance with the present invention.
Figure 2:
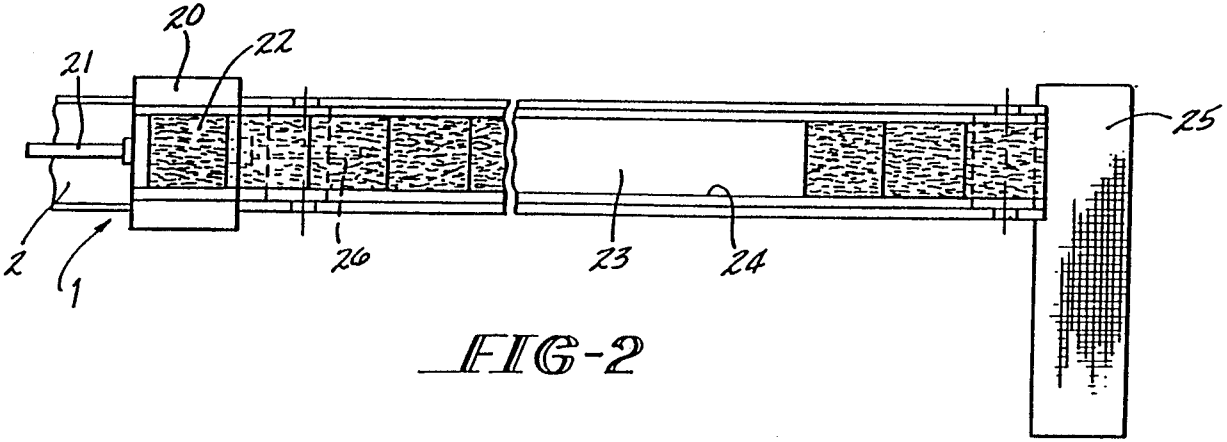

With reference to the drawing, the molding apparatus comprises a circulating conveyor 1 having a conveying line 2 for transporting empty molding boxes from ejector station 20 to molding machines 9 and 10. Conveying line 2 runs under conveying line 15 in the direction indicated by arrow A. At the end of the conveying line 2, the molding boxes 3 delivered by the circulating conveyor 1 are transferred by means of a cylinder 4 in known manner into a transfer apparatus 5 wherein the molding boxes 3 are separated into upper boxes and lower boxes 6 and 7, respectively, and the upper boxes 6 are pushed to one side and the lower boxes 7 are pushed to the other side in order to be introduced by means of cylinder 8 into molding machines 9 and 10, respectively. The mechanism for accomplishing the foregoing is well known in the art and, therefore, is illustrated schematically and forms no part of the instant invention. The molding machines 9 and 10 have movable or fixedly installed sand filling hoppers 11, which can be brought over the upper boxes and lower boxes 6 and 7, respectively, which are located under the corresponding molding machine 9 or 10.

Molds according to the pattern to be cast are produced in the molding machines 9 and 10 from molding sand in known manner. The upper boxes and lower boxes 6 and 7 with the finished molds leave the molding machines 9 and 10, are turned and the backs of the molds are leveled at 12 and are provided with pouring cups and, if desired, cores are inserted. The mold boxes thereafter are passed to a transfer apparatus 13 where an upper box and a lower box 6 and 7 are secured together in order to then be discharged by cylinder 16 as ready-for-casting molding boxes 14 to conveying line 15 of the circulating conveyor 1. The molding boxes are clamped, weighed down or secured with a heavy upper box against ferrostatic buoyancy as is known in the art.

The ready-for-casting molding boxes 14 located on the horizontal conveying line 15 are thereafter sent continuously and in succession to a casting machine 17 which is provided with a nozzle 18. The casting machine 17 may be taken along with the respective molding box 14 during the casting operation along a guide 19, or casting can be performed with a die-casting furnace.

The conveying line 15 conveys the cast molding boxes 14 from the casting machine 17 to an ejector station 20 which is provided with a actuating cylinder 21. The conveying line 15 forms the primary cooling line, the length of which is dimensioned in accordance with the invention so as to insure sufficient time for solidification of the metal casting outer shell so as to be sufficiently firm as to allow for further transportation of the metal casting and surrounding sand mold as a unit after ejection of same from the molding boxes at ejector station 20.

The ejector station 20 ejects the sand molds 22 containing the casting or castings from each molding box 14 onto a horizontal conveyor 23 provided with two lateral guide walls 24. The conveyor 23 forms a secondary cooling line which terminates with a separating apparatus 25 for separating the molding sand from the castings. The conveyor 23 is a circulating or cyclically advanced, parallel or multi-level secondary cooler conveyor.

The sand molds 22 containing the casting or castings are fed successively in an abutting manner from ejector station 22 to conveyor 23 and are supported on five sides on the conveyor 23. The sand molds are supported one against the other in conveying direction, since they are conveyed in succession and abutting one against the other. In addition, they are laterally supported by the guide walls 24 and from underneath by the conveyor 23 and, therefore, are held in a dimensionally stable manner so that the castings cannot tear or burst and thereby become unusable.

The empty molding boxes 14 are pushed, in a known manner, for example by means of a cylinder 26 or crank drive, in the region of the ejector 20 onto the conveying line 2 for transportation back to the molding machines 9 and 10 in a known manner. As noted above, line 2 is located there underneath the conveying line 15.

A cleaning device (not shown) which may be equipped with brushes or cleaners is arranged in the region of the conveying line 2 and serves the purpose of cleaning the inside walls of the molding boxes 14 so that inside walls are as smooth as possible which ensures, on the one hand, a good appearance of the sand mold and, on the other hand, an ejection by the ejector station 20 which is free from damage. In this context it may also be expedient to transport the molding box 14 separately in upper box and lower box 6 and 7 to the transfer apparatus 5, where they are fed to the respective molding machines 9 and 10. In the case of appropriate models to be cast, upper boxes and lower boxes 6 and 7 may also be provided with the molds in a single molding machine.

The molding machines 9 and 10 are preferably machines which operate with precompaction and recompaction in order to obtain a mold which is well-formed and which can be ejected in a dimensionally stable form and readily conveyed over the secondary cooling line. This may involve the use of a double impulse compaction, that is, an impulse compaction with a recompaction taking place by recompression. In this case, a compression plate provided with a peripheral strip is pressed into the back of the mold and, as a result, the molding sand is wedged firmly against the box wall, or the like.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for circulating molds in a molding plant wherein the molding boxes are fed with molding sand from a molding machine so as to form a sand mold and thereafter metal is cast from a casting station into said sand comprising a primary cooling line for cooling said cast mold, ejector means downstream of said primary cooling line for receiving the preliminarily cooled casting, said ejector means including means for removing said cast metal and surrounding sand mold from said molding box in feeding said cast metal and surrounding sand mold to a secondary cooling line downstream of said ejector station in an abutting manner such that said cast metal and surrounding sand mold directly contact each other, said secondary cooling line comprises a horizontal conveyor and lateral guide wall means whereby said cast metal and surrounding sand molds are supported laterally by said guide walls, said horizontal conveyor and said abutting cast metal and surrounding sand molds such that said sand molds are held in a dimensionally stable manner about the metal castings to insure that the metal castings are stable during transport along the secondary cooling line whereby said metal castings are completely solidified.

* * * * *